US010883179B2

(12) United States Patent
Kita et al.

(10) Patent No.: US 10,883,179 B2
(45) Date of Patent: Jan. 5, 2021

(54) METHOD OF PRODUCING A NTCR SENSOR

(71) Applicant: VISHAY ELECTRONIC GMBH, Selb (DE)

(72) Inventors: Jaroslaw Kita, Gefrees (DE); Ralf Moos, Bayreuth (DE); Christian Münch, Warmensteinach (DE); Véronique Poulain, Mons (BE); Michaela Schubert, Kemnath (DE); Sophie Schuurman, Céroux-Mousty (BE)

(73) Assignee: VISHAY ELECTRONIC GMBH, Selb (DE)

( * ) Notice: Subject to any disclaimer, the term of this patent is extended or adjusted under 35 U.S.C. 154(b) by 0 days.

(21) Appl. No.: 16/615,438

(22) PCT Filed: May 3, 2018

(86) PCT No.: PCT/EP2018/061439

§ 371 (c)(1),
(2) Date: Nov. 21, 2019

(87) PCT Pub. No.: WO2018/215187

PCT Pub. Date: Nov. 29, 2018

(65) Prior Publication Data

US 2020/0173031 A1 Jun. 4, 2020

(30) Foreign Application Priority Data

May 22, 2017 (EP) ..... 17172267

(51) Int. Cl.

| | |
|---|---|
| ***H01C 7/04*** | (2006.01) |
| ***C23C 4/12*** | (2016.01) |
| ***C23C 24/08*** | (2006.01) |

(52) U.S. Cl.
CPC ..... *C23C 24/082* (2013.01); *H01C 7/043* (2013.01)

(58) Field of Classification Search
USPC ..... 427/196.7, 901
See application file for complete search history.

(56) References Cited

U.S. PATENT DOCUMENTS 7,553,376 B2 6/2009 Akedo et al.
8,183,973 B2 5/2012 Ryu et al.
(Continued)

FOREIGN PATENT DOCUMENTS

JP 2015115438 A 6/2015
KR 20150113392 A 10/2015

OTHER PUBLICATIONS

Schulze H. et al: "Synthesis, Phase Characterization, and Properties of Chemical Solution-Deposited Nickel Manganite Thermistor Thin Films", Journal of the American Ceramic Society, vol. 92, No. 3, Mar. 16, 2009, pp. 738-744.
(Continued)

*Primary Examiner* — Tabassom Tadayyon Eslami
(74) *Attorney, Agent, or Firm* — Volpe Koenig

(57) ABSTRACT

The present invention relates to a method of producing a negative temperature coefficient resistor (NTCR) sensor, the method comprising the steps of: providing a mixture comprising uncalcined powder and a carrier gas in an aerosol-producing unit, with the uncalcined powder comprising metal oxide components; forming an aerosol from said mixture and said carrier gas and accelerating said aerosol in a vacuum towards a substrate arranged in a deposition chamber; forming a film of the uncalcined powder of said mixture on said substrate; and transforming the film into a layer of spinel-based material by applying a heat treatment step.

20 Claims, 8 Drawing Sheets

(56) References Cited

U.S. PATENT DOCUMENTS

Figure 1:
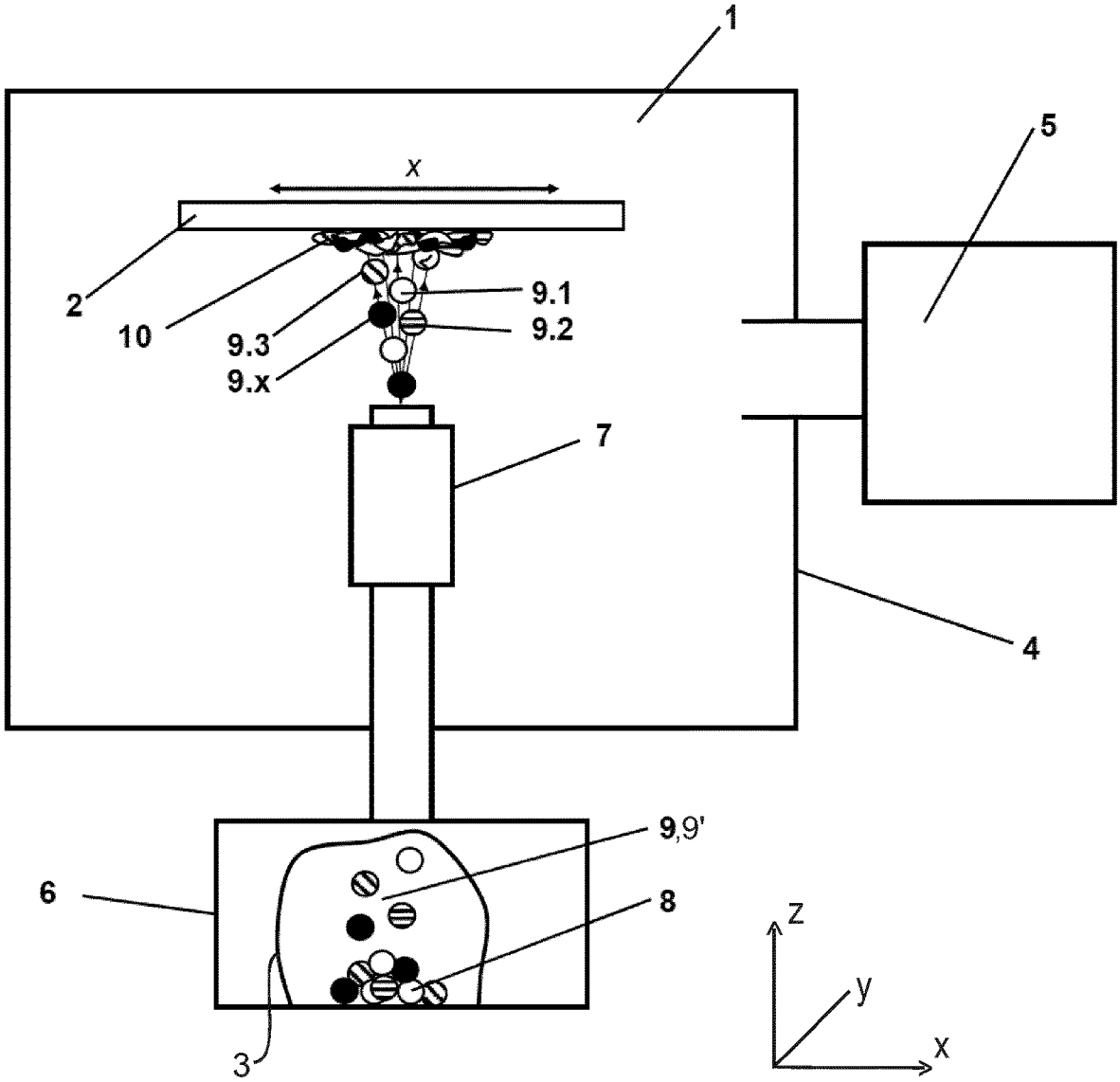

| | | | | |
|---|---|---|---|---|
| 2006/0201419 | A1 | 9/2006 | Akedo et al. | |
| 2010/0259358 | A1* | 10/2010 | Ryu | H01C 7/043 338/22 SD |

OTHER PUBLICATIONS

Hanft et al. "An Overview of the Aerosol Deposition Method: Process Fundamentals and New Trends in Materials Applications," Journal of Ceramic Science and Technology, vol. 6, No. 3, Sep. 2015, pp. 147-182.

* cited by examiner

METHOD OF PRODUCING A NTCR SENSOR

CROSS REFERENCE TO RELATED APPLICATION(S)

This application is a § 371 application of International Application No. PCT/EP2018/061439, filed May 3, 2018, which claims priority to European Patent Application No. 17172267.1, filed May 22, 2017, the entire contents of which are hereby incorporated by reference as if fully set forth herein

FIELD OF INVENTION

The present invention relates to a method of manufacturing negative temperature coefficient resistor (NTCR) sensors from starting oxides with only one multifunctional temperature treatment step below 1000° C.

BACKGROUND

NTCR sensors are temperature-dependent resistor components having a highly negative temperature coefficient. NTCR sensors are generally used for high-precision temperature measurement and temperature monitoring. They are mainly based on semi-conductive transition metal oxides that are provided with contacts and a protective film.

The resistance (R) of a typical NTCR sensor depends on temperature (T) according to the following equation:

$$R(T) = R_{25} \cdot \exp\left(B \cdot \left(\frac{1}{T} - \frac{1}{298.15\text{K}}\right)\right)$$

The value B describes the temperature dependency. It is often denoted as B-constant. $R_{25}$ is the resistance at 25° C. If one considers the resistivity (specific resistance) of the material (ρ), the following temperature dependency can be found:

$$\rho(T) = \rho_{25} \cdot \exp\left(B \cdot \left(\frac{1}{T} - \frac{1}{298.15\text{K}}\right)\right)$$

Now, $\rho_{25}$ is the resistivity at 25° C.

The manufacture of commercial NTCR sensors to date takes place using classic ceramic manufacturing techniques. These classic techniques comprise the manufacture of ceramic powder, e.g. through the mixed oxide route comprising essentially the following sequence of steps: mixing, milling, calcination at 600° C.-800° C., milling, shaping—while adding additives—by means of one of a pressing process, an extrusion process and a film molding process, followed by sintering above 1000° C. and then applying the electrical contacts (sputtering, evaporation or screen printing with a subsequent burning in at 800° C. to 1200° C.).

These manufacturing techniques are very demanding in effort and cost due to the many different steps required to form the sensors.

As a result of this aerosol-based and vacuum-based film deposition processes have been investigated. The general principle underlying aerosol-based and vacuum-based film deposition plants and processes are described in detail in U.S. Pat. No. 7,553,376 B2.

U.S. Pat. No. 8,183,973 B2 describes a deposition process using calcined ceramic material for the formation of NTCR sensors. Like the conventional method of manufacture described in the foregoing, also this method requires the formation of ceramic material in order to be carried out. Following the formation of the ceramic material, the ceramic material is ground to form a ceramic NTCR powder. This powder is deposited as a dense NTCR film on a variety of substrate materials at room temperature. These films are characterized both by a firm adhesion to the substrate as well as a high density and by their typical NTCR characteristics. An additional annealing step is often required to reduce film stresses.

SUMMARY

Due to the various heating steps and the different method steps required, this aerosol-based and vacuum-based film deposition process is also very demanding in effort and cost.

In view of the above it is an object of the present invention to propose a method of manufacture that produces NTC resistors of at least comparable quality to those of the prior art, is highly reproducible and reduces the number of method steps and the cost of manufacture of NTCR sensors.

This object is satisfied by a method having the features of claim 1.

Such a method of producing a negative temperature coefficient resistor sensor comprises the steps of:

- providing a mixture comprising uncalcined powder and a carrier gas in an aerosol-producing unit, with the uncalcined powder comprising metal oxide components;
- forming an aerosol from said mixture and said carrier gas and accelerating said aerosol in a vacuum towards a substrate arranged in a deposition chamber;
- forming a film of the uncalcined powder of said mixture on said substrate; and
- transforming the film into a layer of spinel-based material by applying a heat treatment step.

The invention thus relates to a method of manufacturing NTCR sensors directly from an uncalcined powder mixture including two or more metal oxide components that represent the desired spinel-based material to be formed on the substrate of the intended NTCR sensor. This is in stark contrast to the method described e.g. in U.S. Pat. No. 8,183,973 B2, where ceramic spinel-based mixed crystal particles have to be formed in an elaborate way prior to being accelerated in a corresponding plant.

The expressions "uncalcined" and "metal oxide" as they are used throughout this document are described in the following. Metal oxides as meant in this document comprise classical metal oxides, e.g. with the composition $MO_z$ (with M being a metal and O being oxygen and z being a number), or all other salts of this metal M like for instance carbonates, nitrates, oxynitrates, oxycarbonates, hydroxides and so on. An uncalcined powder as meant in this document is a powder that exists as a metal oxide as defined above, typically in a state as derived from the supplier or after an additional low temperature thermal annealing step that makes the powder better sprayable. Uncalcined powder mixtures are mixtures of said metal oxides, preferably low temperature annealed to improve sprayability at an annealing temperature that is so low that solid state reactions between the powders that form the final phase can be neglected.

This novel approach thereby significantly reduces the amount of heat treatment steps required to make at least comparable NTCR sensors, this leads to a significant reduction in the cost of production of such NTCR sensors.

It has namely been established that accelerating the compounds of powder intended to form the spinel-based material results in sufficient kinetic energy of the particles of the powder such that on the impact onto the substrate this leads to a local pressure increase, to a local temperature increase and to a plastic deformation and to a breaking up of the particles. All of these processes beneficially result in an adhesion both between the particles and between the particles and the substrate. On carrying out the heat treatment step, the components of the composite film crystallize into common spinel structure and film strains and/or grain boundaries are reduced.

On depositing the aerosol as a film on the substrate, an anchor layer is initially formed on the substrate and the film is then continuously formed on the anchor layer. During the continued bombardment with new particles of the powder, the deposited film not only becomes thicker, but it is also further subjected to a compaction that is beneficial to the production of the layer of spinel-based material.

Advantageously, the heat treatment step is carried out at a temperature below 1000° C., in particular in the range of 600° C. to 1000° C., i.e. in a temperature range at which the spinel-based structure forms, preferably in the range of 780° C. to 1000° C., i.e. a temperature at which the spinel-based structure forms in a desirable time frame and at which the strains present in the layer are significantly reduced. This means that only one single multifunctional temperature treatment be-low 1000° C. is carried out on conducting the method in accordance with the invention.

The basic idea underlying the present invention is thus that a composite film is first produced on a suitable substrate by means of the aerosol-based and vacuum-based cold composite deposition and this composite film is subsequently temperature treated once at ≤1000° C., thus below the typical sintering temperature that is carried out in the prior art.

Preferably, the heat treatment step takes place in an atmosphere, wherein said atmosphere preferably has a controlled partial oxygen pressure. Such atmospheres can readily be made available by e.g. simply introducing air or an appropriate gas into an appropriate furnace.

In another embodiment, the heat treatment step can be carried out in the deposition chamber in which the deposition process was carried out on increasing the pressure within the deposition chamber following the vacuum deposition process.

It is preferred if the carrier gas for the deposition is selected from the group of members consisting of oxygen, nitrogen, a noble gas and combinations thereof. Such carrier gases can readily be made available in a cost effective manner and lead to the deposition of uniform and dense composite films in an advantageous manner.

Preferably, the uncalcined powder comprises particle sizes selected in the range of 50 nm to 10 μm. These powder sizes lead to particularly uniform and dense composite films being formed on the substrate.

It is preferred if the subsequently formed layer of spinel-based material comprises two or more cations from the group of members consisting of Mn, Ni, Co, Cu, Fe, Cr, Al, Mg, Zn, Zr, Ga, Si, Ge and Li, with the formed layer of spinel-based material for example being described by one of the following chemical formulas:

$$M_xMn_{3-x}O_4,\ M_xM'_yMn_{3-x-y}O_4,\ \text{and}\ M_xM'_yM''_zMn_{3-x-y-z}O_4$$

where M, M' and M" are selected from the group of members consisting of Ni, Co, Cu, Fe, Cr, Al, Mg, Zn, Zr, Ga, Si, Ge and Li, with x+y≤3, or with x+y+z≤3 respectively; and wherein said uncalcined powder comprises compounds of at least one of M, M' and M". In this connection it should be noted that compounds of the spinel-based material can also comprise more than three cations. Additionally or alternatively, the above compounds can include dopant material. The exact material used as a composition of the film is selected in dependence on the application of the desired NTCR sensor.

The listed materials are all capable of forming the desired spinel-based structure. The spinel-based structure of such compounds is the starting requirement for forming NTCR sensors.

In this connection it should be noted that x, y, z etc. can be any number between and including 0 and 3.

Advantageously said uncalcined powder comprises at least two different metal oxide components. A simple and cost effective NTCR sensor can be formed on the basis of two metal oxide components.

It is preferred if said mixture further comprises at least one filling material component. It should be noted that the filling materials can either be an inactive material, such as $Al_2O_3$, and are included to tailor e.g. the resistance of the NTCR sensor to the specific application. Alternatively or additionally, the filling material can be a dopant material of the oxide material used to form the spinel based structure. Such a dopant material can lead to further improved or desired characteristics of the spinel based layer of the NTCR sensor.

Preferably the method comprises the further step of forming at least one further layer or structure on at least one of the substrate, the film before applying said heat treatment step, and the layer of spinel-based material. In this way e.g. electrically conductive components that are intended to form at least one electrode structure of the NTCR sensor can be provided at the substrate, particularly prior to the heat treatment step.

In a preferred embodiment of the invention, the at least one further layer or structure is sintered once it has been applied. In this connection, the same heat treatment step is applied as a single heat treatment step for transforming the film into a layer of spinel-based material and for sintering the at least one further layer or structure. Thus, one and the same heat treatment step can beneficially be used to achieve a transformation of the starting material into the spinel-based structure and e.g. for sintering the electrode structures to the spinel-based structure in order to enhance the electric connection between the electrode structure and the spinel-based structure.

This temperature treatment step is then beneficially also used for sintering electrodes or electrode structures which had previously been applied to the composite film by means of thick film technology if said electrodes or electrode structures are not already located on the substrate or are subsequently applied using any known processes to apply electrodes. As electrode applying processes, e.g., thick film processes, a chemical vapor deposition (CVD) process, a physical vapor deposition (PVD) process, a plasma-enhanced chemical vapor deposition (PECVD) process, a sol-gel process and/or a galvanization process can be used. A subsequent temperature strain on the NTCR film as a consequence of the contacting, which can result in age-determining oxidations, can be desirably compensated by means of this single heat treatment step.

The invention thereby offers the advantage that only one single temperature treatment up to 1000° C. is necessary for manufacturing an NTCR sensor that is stable in the long term. Both a significant saving of energy and work steps can thereby be achieved and a subsequent oxidation or also aging of the NTCR film, as a consequence of the contacting, can be avoided.

During the conventional route of manufacture the prior art NTCR sensors are treated by a plurality of temperature treatment steps, namely firstly for powder calcination (part spinel formation) at 600° C.-800° C., secondly sintering at >1000° C. (complete spinel formation) and thirdly a burning in of the screen printing contacts at >800° C.

The previously known method of aerosol-based and vacuum-based cold deposition as discussed in U.S. Pat. No. 8,183,973 B2 also requires a plurality of temperature treatment steps: firstly for powder calcination (complete spinel formation) at >850° C., secondly an optional burning in of the screen printing contacts at >800° C. (if not produced by other methods e.g. PVD) and thirdly a film temperature control at 500° C.-800° C. to reduce film stress. In addition to only requiring one temperature treatment step, the present invention does not require a powder milling procedure with a subsequent powder drying and powder granulation step thereby a significant number of work steps and energy is saved.

Preferably the at least one further layer or structure is selected from the group of members consisting of: an electrode, an electrically conducting layer or structure, an electrically insulating layer or structure, an electrically insulating but thermally conducting layer or structure, a protective film, a thermally conducting layer and combinations of the foregoing. Such layers enable the formation of a wide variety of NTCR sensors for different applications.

Advantageously said at least one further layer or structure is applied using thick film technology, a chemical vapor deposition (CVD) process, a physical vapor deposition (PVD) process, a plasma-enhanced chemical vapor deposition (PECVD) process, a sol-gel process and/or a galvanization process. Optionally, the at least one further layer or structure can be structured by means of a laser beam, an electron beam, a sand jet or a photolithographic process. In this way tried and tested processes can be employed to provide layers and structures with desired characteristics, shapes and sizes.

Preferably the method comprises the further step of introducing at least one mask into the deposition chamber, with the at least one mask being arranged between the aerosol-producing unit and the substrate. Using a mask several NTCR sensors can be manufactured in one batch providing a cost effective method of manufacturing a plurality of NTCR sensors.

Particularly preferably, the method comprises the further step of adapting a resistance of the NTCR sensor by means of changing a size of the film formed on the substrate or of the layer of spinel-based material, with the change in size optionally being effected by mechanical trimming processes, such as by means of a laser beam, an electron beam or a sand jet. Thus, NTCR sensors of pre-defined resistance and/or shape can be made available, with the pre-defined resistance and/or shape being able to be tailored to specific uses of the NTCR sensor.

Advantageously, the method comprises the further step of introducing further materials, particularly said filling materials, into at least one of said mixture, said film and said at least one further layer or structure. By providing a method during which at least one further substance can be introduced into any one of the layers or structures formed on the substrate, characteristics of these layers and structures can be beneficially influenced in a desirable manner.

Preferably, said aerosol-producing unit comprises a nozzle via which said aerosol is accelerated towards said substrate, wherein said step of forming a film on said substrate comprises moving said substrate and said nozzle relative to one another in order to define an extent of the film. By providing a moveable substrate, composite films respectively NTCR sensors of varying area can be produced or a plurality of NTCR sensors can be produced in batch process thereby made available. In this way NTCR sensors having a desired shape and size can be easily formed in a fast and economic way.

BRIEF DESCRIPTION OF THE DRAWING(S)

Figure 2:
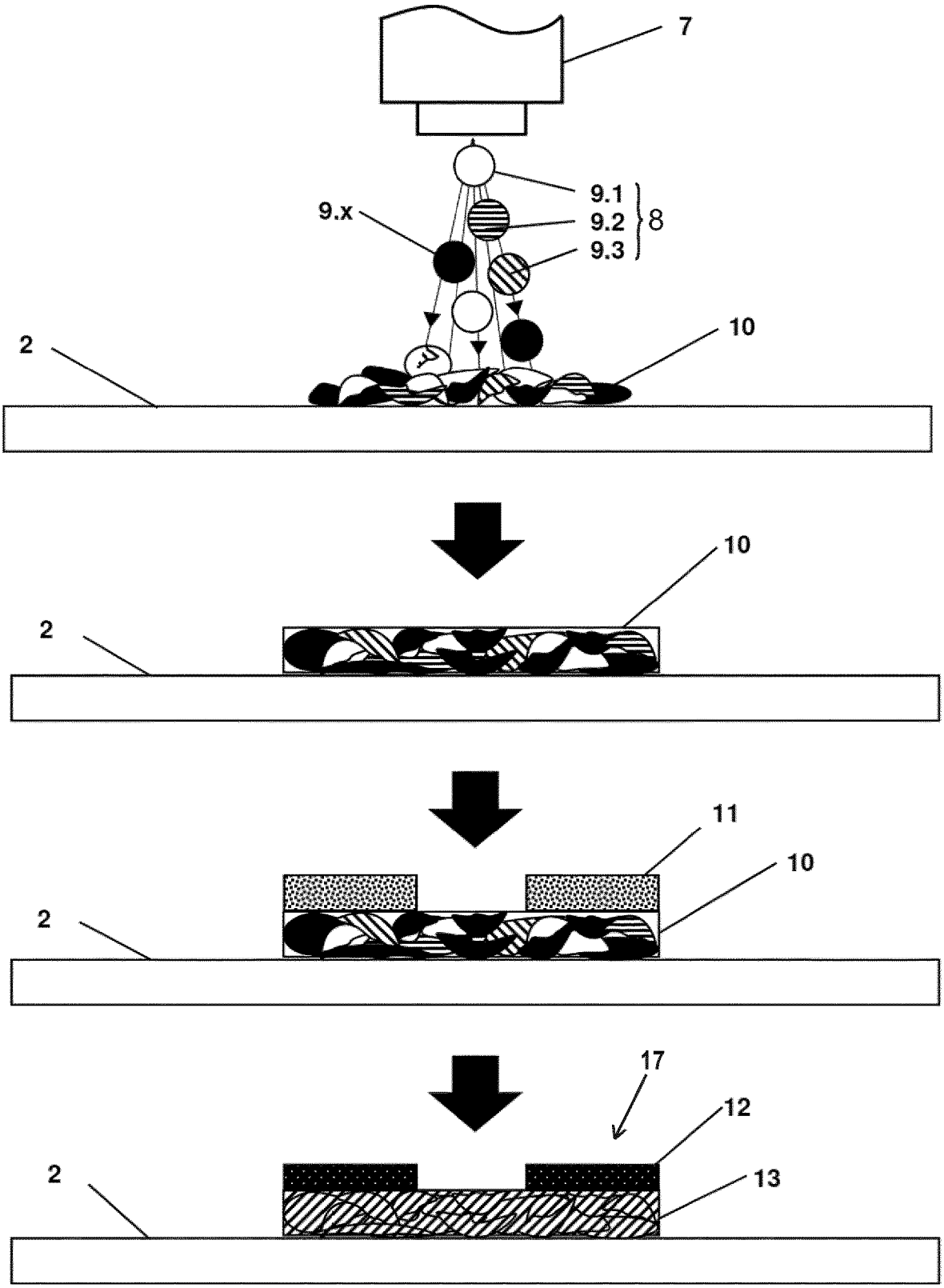
Figure 3:
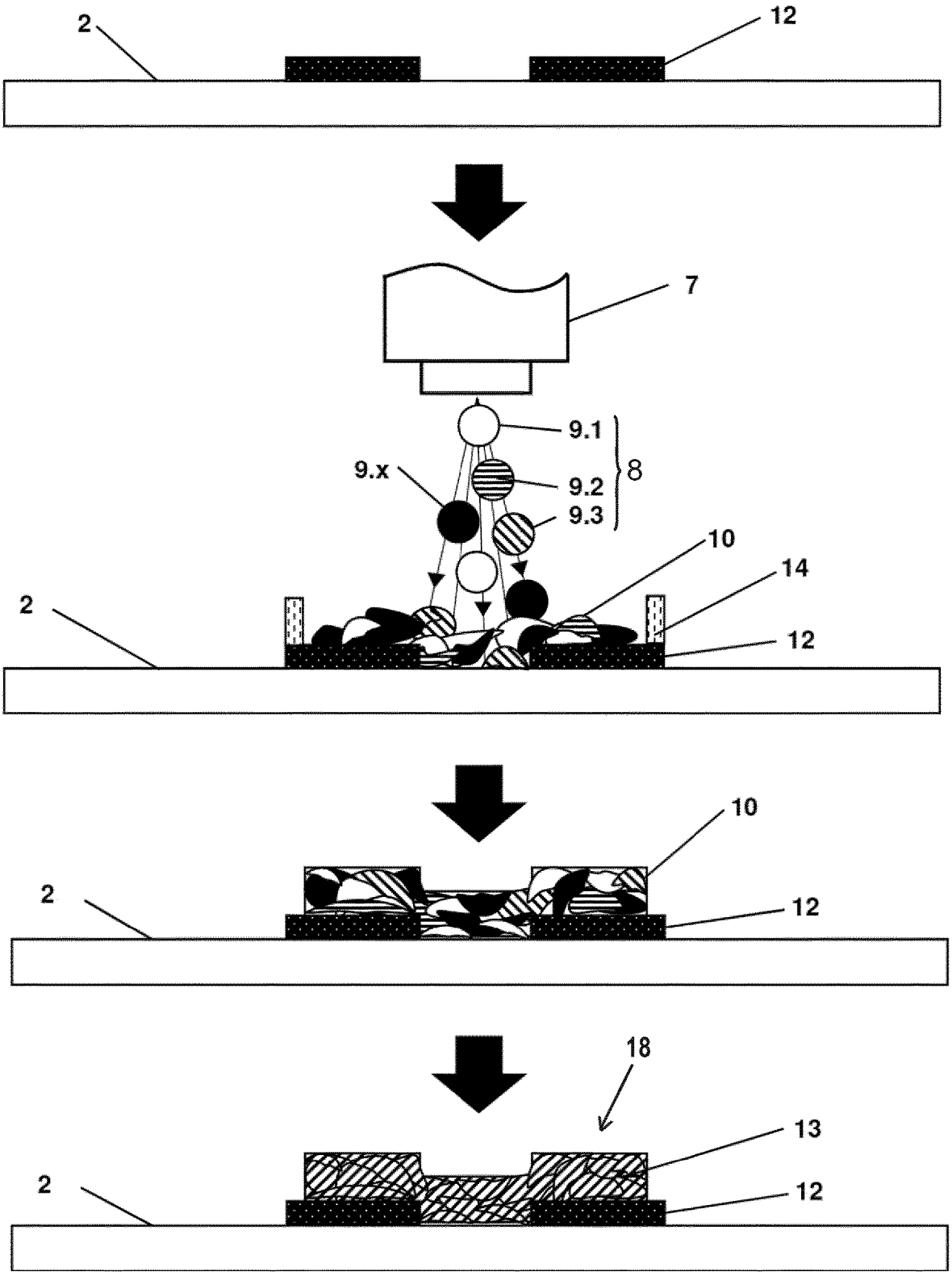
Figure 4:
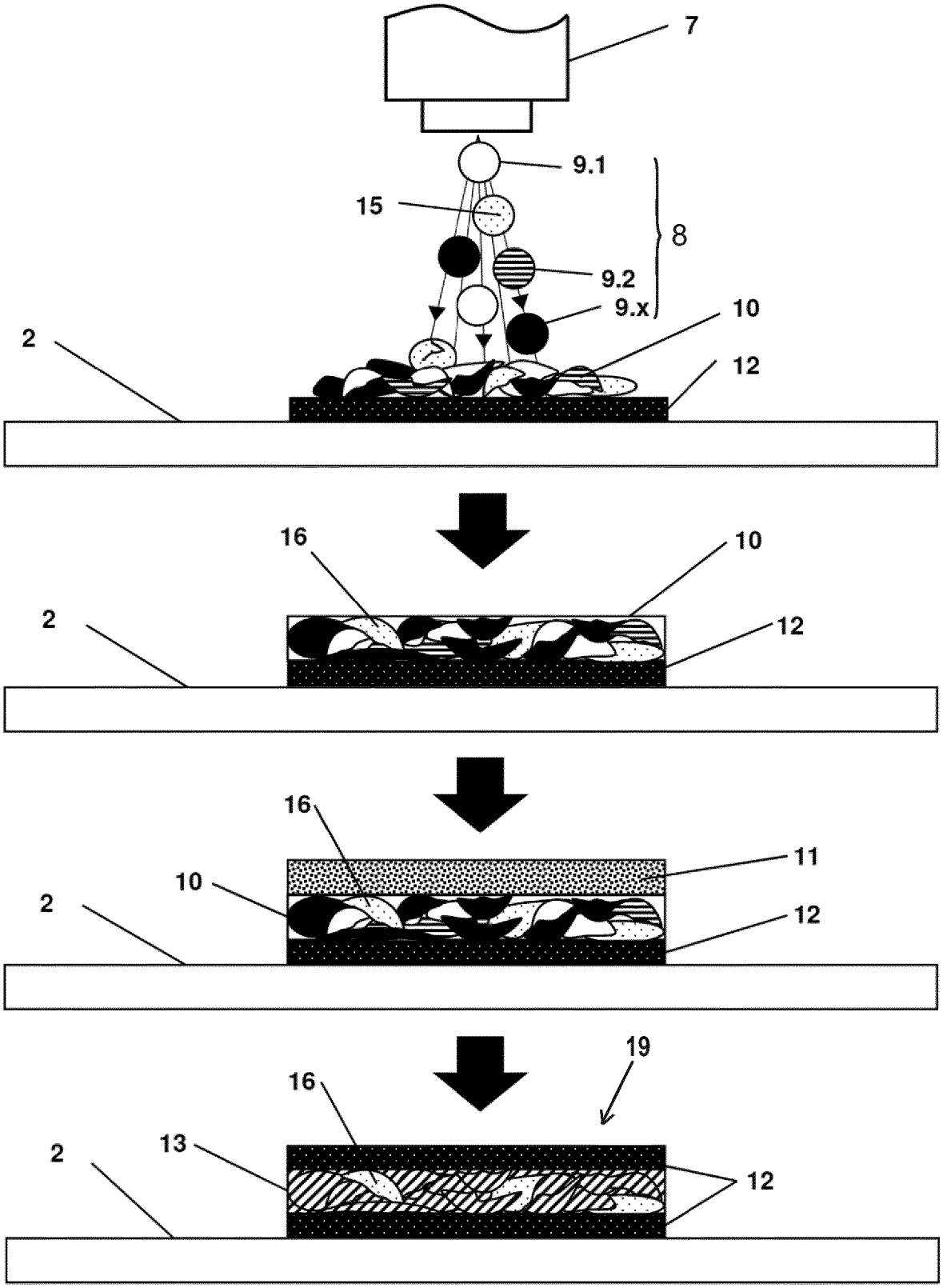
Figure 5:
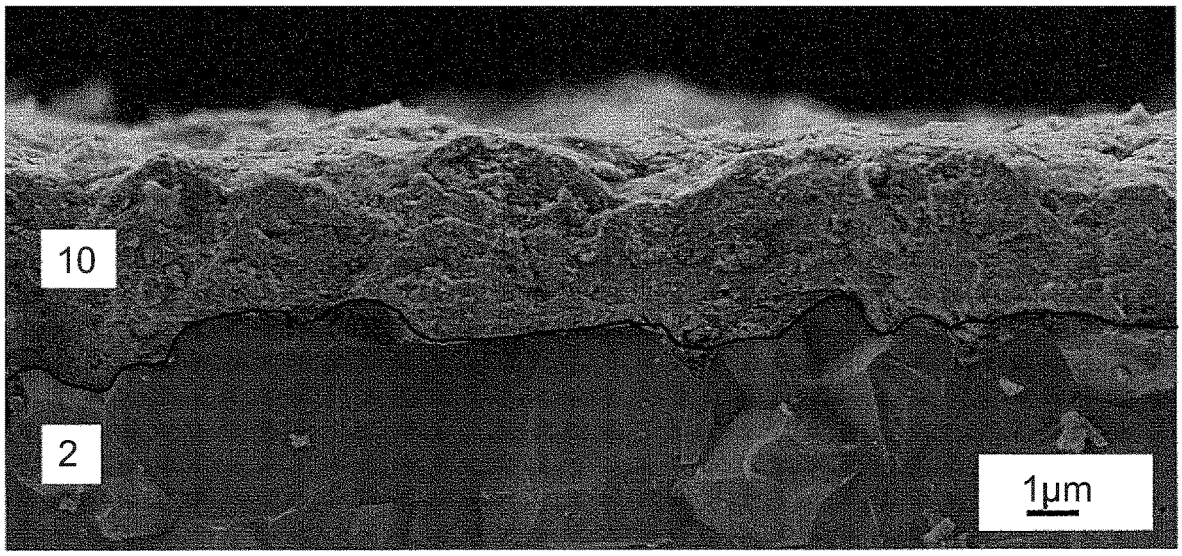
Figure 6:
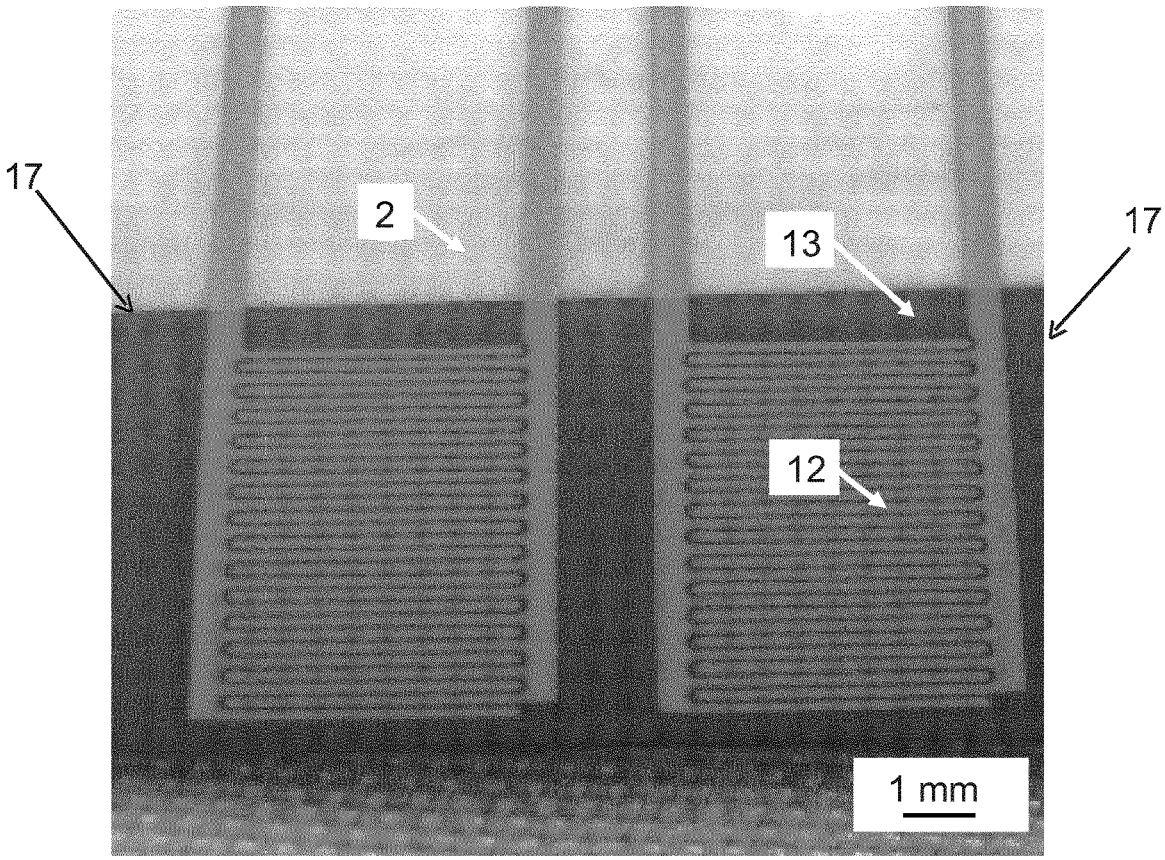
Figure 7:
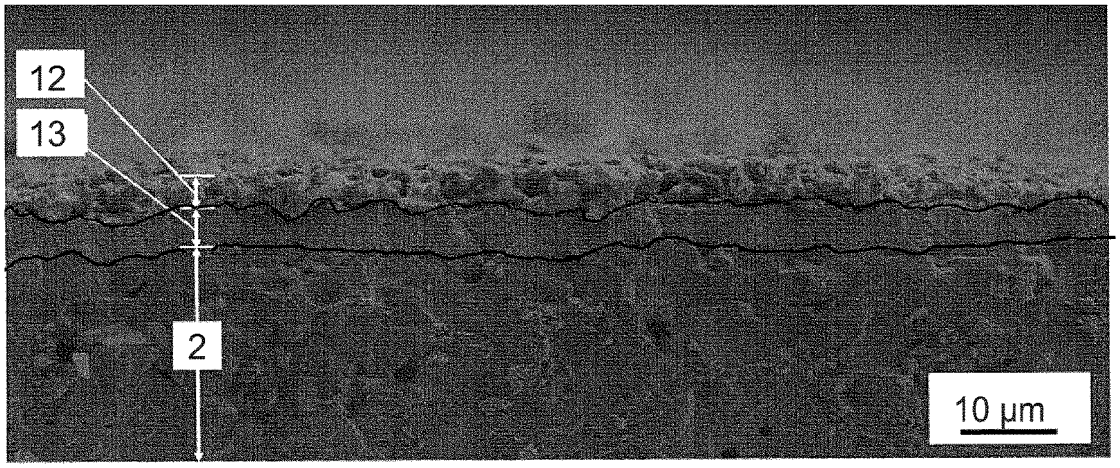
Figure 10:
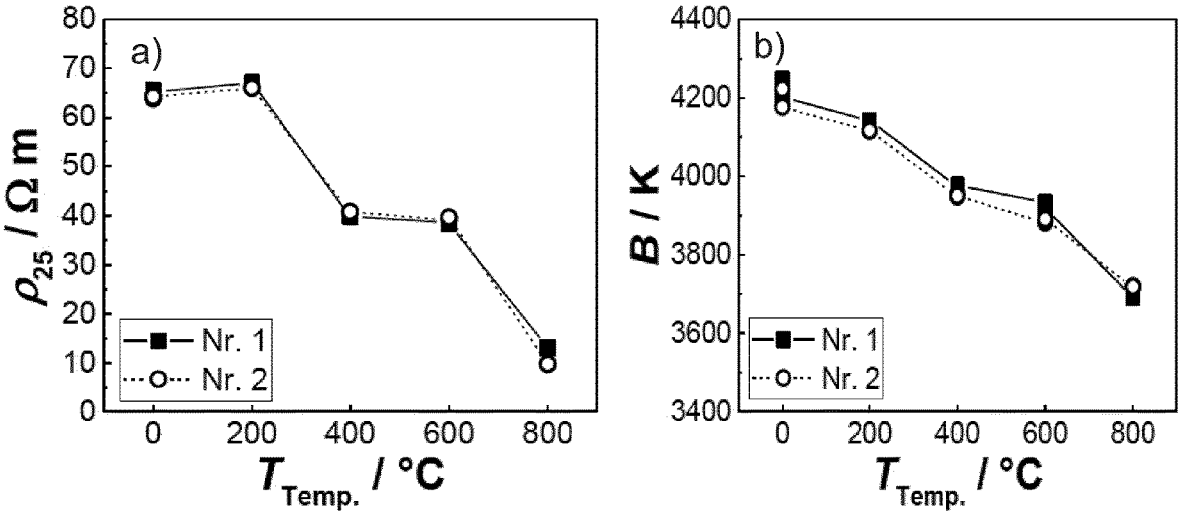
Figure 11:
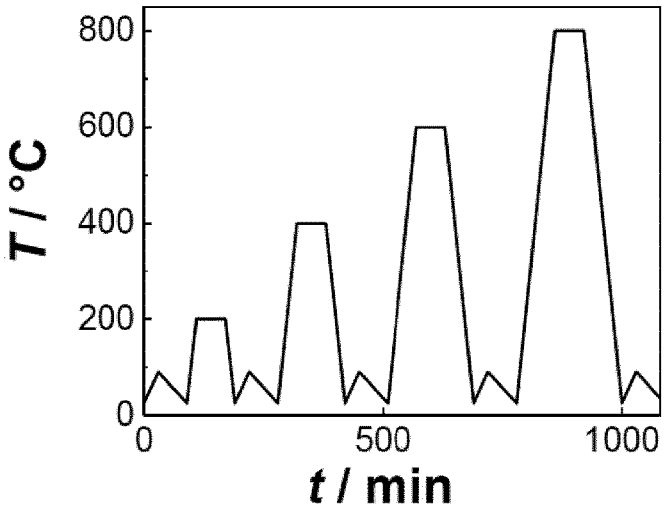

Further embodiments of the invention are described in the following description of the Figures. The invention will be explained in the following in detail by means of embodiments and with reference to the drawing in which is shown:

FIG. 1 a schematic view of an apparatus for forming NTCR sensors in accordance with the invention;

FIG. 2 a schematic drawing highlighting the method steps used during a first embodiment of the invention;

FIG. 3 a schematic drawing highlighting the method steps used during a second embodiment of the invention;

FIG. 4 a schematic drawing highlighting the method steps used during a third embodiment of the invention;

FIG. 5 an SEM image of the fractured surface of a NiO—$Mn_2O_3$ composite film on an $Al_2O_3$ substrate;

FIG. 6 a photograph of two NTCR sensors after the completion of the third method step of the embodiment of the invention described in connection with FIG. 2;

FIG. 7 an SEM image of the fractured surface of an NTCR sensor from FIG. 6 which is temperature-treated at 850° C.;

FIGS. 8*a* and *b* the electrical characterization of the two NTCR sensors of FIG. 6, with FIG. 8*a* showing the $\rho_{25}$ specific resistance in dependence on temperature and FIG. 8*b* showing the B-constant of each sensor;

FIGS. 9*a* and *b* the $\rho_{25}$ specific resistance (FIG. 9*a*) and the B-constant (FIG. 9*b*) of an NTCR sensor formed by means of the process described in connection with FIG. 2, both in dependence on tempering temperature;

FIGS. 10*a* and *b* graphs similar to those of FIGS. 9*a* and 9*b*, but for an NTC resistor using a prior art method;

FIG. 11 a drawing showing the measurement and tempering temperature cycle used to obtain FIGS. 9 and 10; and FIG. 12 an XRD spectrum of an NTCR sensor formed by means of the process described in connection with FIG. 2.

DETAILED DESCRIPTION OF THE PREFERRED EMBODIMENT(S)

In the following, the same reference numerals will be used for parts having the same or equivalent function. Any statements made having regard to the direction of a component are made relative to the position shown in the drawing and can naturally vary in the actual position of application.

The principle of aerosol-based and vacuum-based cold deposition of NTCR sensors 17 (see FIG. 2) will be explained in the following with reference to FIG. 1. FIG. 1 shows an apparatus 1, in which a substrate 2 is provided. A mixture 3 of powder 8 and a carrier gas 9' is deposited as an aerosol 9 on the substrate 2 in a deposition chamber 4. The apparatus 1 can be evacuated using an evacuation apparatus 5, such as a vacuum pump or a system of vacuum pumps.

An aerosol-producing unit 6 comprising the mixture 3 is connected to the deposition chamber 4. The mixture 3 is directed and accelerated towards the substrate 2. The acceleration of the mixture 3 is brought about as a consequence of the pressure difference between the aerosol-producing apparatus 6 and the evacuated deposition chamber 4. The mixture 3 is accelerated solely due to the applied vacuum and not because of any external fields, such as magnetic or electric fields. The mixture 3 is transported from the aerosol-producing unit 6 via a suitable nozzle 7 into the deposition chamber 4. The mixture is accelerated further due to the change in the cross-section of the nozzle 7. In the deposition chamber 4, the mixture 3 impacts the moving substrate 2 and forms a dense, scratch-resistant film there.

The mixture 3 is composed of an uncalcined powder 8. This is significantly different to the prior art, where a calcined powder is ground prior to deposition on a substrate. The uncalcined powder 8 is then mixed with a carrier gas 9' (e.g. oxygen, nitrogen or a noble gas) in the aerosol-producing unit 6 such that the mixture 3 of powder 8 and aerosol 9 is formed.

In this connection it should be noted that an uncalcined powder 8 relates to a powder of the individual metal oxide compounds 9.1, 9.2, 9.3, . . . **9.*x* used to form the NTCR sensors 17 (see FIG. 2). This uncalcined powder 8 has not been sub-jected to a heat treatment step during which a ceramic form of the desired composition of the NTCR sensor 17** is produced.

The powder 8 in this respect in accordance with FIG. 1 comprises x powdery components 9.1, 9.2, 9.3, . . . **9.*x* (where x≥2) selected from the group of metal oxides. Thus, 9.1 denotes a first metal oxide component, 9.2 a second metal oxide component, 9.3 a third metal oxide component and 9.*x* an $x^{th}$ metal oxide component. The metal oxide powder 9.1, 9.2, 9.3, . . . 9.*x*** typically has particle sizes selected in the range of 50 nm to 10 μm.

Due to the pressure difference between the aerosol-producing unit 6 and the deposition chamber 4, the particles 9.1 . . . **9.*x* (metal oxide component 1 . . . x) and the carrier gas 9' of the mixture 3 are transported via the nozzle 7 into the deposition chamber 4 and are accelerated towards the substrate 2. The particles 9.1 . . . 9.*x* and the carrier gas 9' of the aerosol 9 impact on the substrate 2 and form a firmly adhering, scratch-resistant composite film 10 on the substrate 2**.

In order to increase a surface area of the composite film 10 formed on the substrate 2, the substrate 2 is moved relative to the nozzle 7 in the x-direction and/or the y-direction. The spatial directions X, Y and Z are also indicated in FIG. 1.

FIG. 2 shows a schematic drawing highlighting the method steps used during a first embodiment of the invention. In the first step of the method, a powder mixture 8 which is composed of x metal oxide components (where x≥2) is deposited on the substrate 2 (e.g. formed of $Al_2O_3$ or AlN) by means of an aerosol-based and vacu-um-based cold composite deposition process (as schematically described in connection with FIG. 1). The metal oxide components 9.1 to **9.*x* of the mixture 3** can comprise elements, such as Ni, Mn, Co, Cu or Fe.

In this connection, it should be noted that the components are starting metal ox-ides of a composite that can be transformed preferably into a spinel-structure, i.e. into preferably a cubic crystal system well known for compositions comprising Mn. The spinel structure, i.e. the cubic structure of the composition, is not yet present in this starting material and is formed during the application of the subsequent method.

The deposition is based on the fact that the powder mixture 8 is accelerated by means of the combination of the aerosol 9 and the vacuum present in the deposition chamber 4. The particles of the metal oxide component 9.1, the metal oxide component 9.2, the metal oxide component 9.3, . . . the metal oxide component **9.*x*, and the carrier gas 9' are directed via the nozzle 7 onto the substrate 2. On impact at the substrate 2, the particles 9.1, 9.2, 9.3 . . . 9.*x* break open, bond with one another and with the substrate 2, without changing their crystal structure in this respect, and form the firmly adhering composite film 10**.

Subsequently, in the second step of the method, two further layers 1 1 are applied on the composite film 10. In the present instance they are intended to form two electrode structures 12 that are applied to the surface of the composite film 10 by means of an appropriate film technology, e.g. by screen printing or stencil printing of conductive paste 11 on the composite film 10 of composite material.

In the subsequent third method step, the composite film 10 having the conductive paste 11 present thereon is heat treated in a heat treatment step. The heat treatment step is carried out at a temperature below 1000° C., preferably in the range of 600° C. to 1000° C., in particular in the range of 780° C. to 1000° C., particularly preferably at 850° C. to 1000° C. The temperature depends on the desired composition of the layer 13 of spinel-based material. During this heat treatment step, several processes take place simultaneously.

In this connection, it should be noted that the heat treatment step takes place in an atmosphere, such as air. Alternatively, the heat treatment step can also be carried out using an atmosphere having a controlled partial oxygen pressure.

During this heat treatment step, two significant effects are achieved. On the one hand, the screen-printed conductive paste 11 is sintered forming the electrode structures 12 and, on the other hand, the metal oxides, e.g. oxides of Ni, Mn, Co, Cu or Fe, of the composite film 10 are crystallized into a common spinel structure, i.e., the film of composite materials is transformed into a layer 13 of spinel-based material.

Generally speaking, a composition of the film 10 of composite material and of the subsequently formed layer 13 of spinel-based material is described for example by one of the following chemical formulas $M_xMn_{3-x}O_4$, $M_xM'_yMn_{3-x-y}O_4$, and $M_xM'_yM''_zMn_{3-x-y-z}O_4$, where M, M' and M'' are selected from the group of members consisting of Ni, Co, Cu, Fe, Cr, Al, Mg, Zn, Zr, Ga, Si, Ge and Li. In order to ensure this, the uncalcined powder comprises compounds of at least one of M, M' and M''. In this connection it should be noted that x, y and z can be any number between and including 0 and 3.

On the other hand, the heat treatment affects grain growth and, at a moderate cooling rate, a reduction of the film strains such that an NTCR behavior of the NTCR sensor 17 is achieved which has long-term stability. The NTCR behavior is a consequence of the spinel-structure of the composition.

Thus, the step of transforming said composite film 10 into said layer 13 of spinel-based material comprising the heat treatment step simultaneously transforms the at least one further layer, e.g. the two the screen-printed portions of conductive paste 11 into two electrode structures 12, while also forming the spinel-structure.

The NTCR sensor 17 formed comprises the substrate 2, a spinel-based layer 13 and the sintered electrode structures 12. Alternatively to the thick film technology in the second method step, one or more electrodes and/or electrode structures 12 can also be applied to the spinel-based layer 13 using a PVD process, such as sputtering or evaporation. If the electrodes or electrode structures 12 are directly formed, then they can be applied after the heat treatment of the composite film 10.

The electrodes or electrode structures 12 can optionally be structured by means of lasers or in a photolithographic manner.

The NTCR sensors 17 work as desired due to the spinel structure of the layer 13 of spinel-based material. Without the transformation of the starting material to the spinel-based structure (see e.g. FIG. 12 in this connection), the desired properties of such NTCR sensors 17 would not be obtained.

FIG. 3 shows a schematic drawing highlighting the method steps used during a second embodiment of the invention (NTCR sensor 18). In contrast to the embodiment shown in FIG. 1 an electrode or an electrode structure 12 is provided on the substrate 2 prior to the formation of the composite film 10. The electrodes or electrode structures 12 are applied to the substrate 2, e.g. with the aid of a PVD process (e.g. evaporation, sputtering), thick film technology, a galvanization process or similar and are optionally structured by means of a laser beam or an electron beam or a photolithographic process (not shown).

In the second step, aerosol-based and vacuum-based cold composite deposition takes place, optionally using a suitable mask 14 (one-way stencils/multiway stencils, sacrificial material, etc.).

Subsequently, a temperature treatment of the composite film 10 at temperatures up to 1000° C. takes place in the third step such that the desired spinel structure is formed and process-related film strains and grain boundaries are reduced.

A subsequent trimming of the layer 13 of spinel-based material is possible, e.g. by means of a laser beam or an electron beam, to set the resistance value of the created spinel-based layer 13 in an exact manner.

FIG. 4 shows a schematic drawing highlighting the method steps used during a third embodiment of the invention (NTCR sensor 19). The starting point is a conductive substrate or a substrate that is provided with a conductive film or electrode 12. The latter can, in analogy to FIG. 3, be applied e.g. by a PVD process, a CVD process, a PECVD process, thick film technology, a galvanization process, a sol-gel process or similar and can optionally be structured by means of a laser beam or an electron beam or in a photolithographic manner.

In the second step, a composite film 10 is deposited onto this electrode or electrode structure 12 with the aid of the aerosol-based and vacuum-based cold composite deposition of a powder mixture 8.

The powder mixture 8 in this respect not only comprises x metal oxide components (where $x \geq 2$) that form the later spinel-based layer 13, but also filler material components 15. The latter can indeed likewise belong to the group of metal oxides such as $Al_2O_3$, but are not installed into the spinel lattice, which is active with respect to NTCR, and thus serve to set/increase the resistance value in the later so-called sandwich structure.

The powder mixture 8 is, as described in FIG. 1, mixed with the carrier gas 9' for the purpose of acceleration. The particles of the aerosol, i.e. the particles of the metal oxide component 1, 2, . . . x 9.1, 9.2 . . . **9.*x*, as well as the filling material particles 15, move out of the nozzle 7 at a higher speed and impact onto the electrode or electrode structure 12 located on the substrate 2. Suitable particles in this respect break open, deform plastically and form a firmly adhering, scratch-resistant composite film 10**.

It should be noted that the filling materials 15 can also be inactive with respect to the material of the layer 13 of spinel-based material of the NTCR sensor 19, such as $Al_2O_3$, and are included in addition to the starting metal oxides of the spinel.

On the other hand, the filling material 15 can be a dopant material of the oxide material used to form the spinel-based structure. Such a dopant material can lead to improved or desired characteristics of the spinel-based layer 13 of the NTCR sensor 19.

A conductive paste 11 is applied to the surface of the composite film 10 by means of thick film technology in the next step.

In the subsequent temperature treatment step that takes place up to 1000° C., the sintering of the conductive paste 11, as well as the reduction of film strains and grain boundaries and the crystallization of some of the composite film 10 components in a common spinel structure take place simultaneously. The remaining part, this means the filling material grains 16 in the film, are present unchanged after the temperature treatment. Alternatively to thick film technology, the electrode 12 can also be applied subsequently, that is after the temperature treatment, by a PVD process such as sputtering or evaporation.

The structure created in this manner on the substrate 2 comprises an electrode 12, the spinel-based layer 13 and the further electrode 12 to form a so-called sandwich structure. The filling material grains 16, which are present distributed finely in the spinel-based layer 13, form a simple possibility of raising or setting the resistance value, which is low due to the small NTCR film thicknesses of just a few μm, in a defined manner.

In view of the foregoing, it can thus be summarized that at least one further layer or structure can be formed on at least one of the substrate, the film and the layer of spinel-based material. In this connection, the at least one further layer or structure can be provided before the step of forming said film, following the step of forming said film or following the step of transforming said film into the layer of spinel-based material.

It should further be noted that the at least one further layer or structure is selected from the group of members consisting of an electrically insulating layer or structure, an electrically insulating but thermally conducting layer or structure, an electrically conducting layer or structure, such as an electrode, a protective film and a thermally conducting layer.

Depending on when and where the at least one further layer or structure is applied, said at least one further layer or structure can be applied using thick film technology, a CVD process, a PVD process, a sol-gel process and/or a galvanization process; with the at least one further layer or structure optionally being structured by means of a laser beam, an electron beam, a sand jet or a photolithographic process or similar.

By way of example an NTCR sensor 17 can be formed by providing a Cu substrate 2, a layer of electrically insulating and preferably thermally conductive material, such as $Al_2O_3$, can be deposited directly on the Cu substrate 2. A composite film 10 of NiO and $Mn_2O_3$ is then deposited on this layer of preferably thermally conductive but electrically insulating material. One then proceeds as described in connection with FIG. 2 to form two electrodes 12 on this layer 10.

Such an NTCR sensor 17 formed on a Cu substrate 2 can then be placed, e.g. directly in the vicinity of engine components in order to e.g. monitor the temperature in a cylinder of an engine (not shown) to carry out a high-precision temperature measurement of the cylinder and monitor the temperature development thereof in real time.

FIG. 5 shows an SEM image of the fractured surface of a NiO—$Mn_2O_3$ composite film 10 on an $Al_2O_3$ substrate 2 in accordance with the first method step of an embodiment of the invention described in connection with FIG. 2. In this first step, a powder mixture comprising two metal oxide components 9.1, 9.2, namely NiO and $Mn_2O_3$, is formed on the $Al_2O_3$ substrate 2 by means of the aerosol-based and vacuum-based cold composite deposition process. The NiO—$Mn_2O_3$ composite film 10, which is produced in this respect and is shown in FIG. 5, has a high density, a good bonding with the $Al_2O_3$ substrate 2 and grains in the umpteen nm range.

In FIG. 6, two possible NTCR sensors 17 are shown after the completion of the third method step of the embodiment of the invention described in FIG. 2. In accordance with this embodiment, an aerosol-based and vacuum-based cold composite deposition of a two-component metal oxide powder mixture of NiO and $Mn_2O_3$ onto an $Al_2O_3$ substrate 2 took place in the first step. An AgPd conductive paste 1 1 was subsequently applied by screen-printing onto the NiO—$Mn_2O_3$ composite film 10 in the second step. In the third step, a temperature treatment of the compound took place at 850° C.

Figure 8:
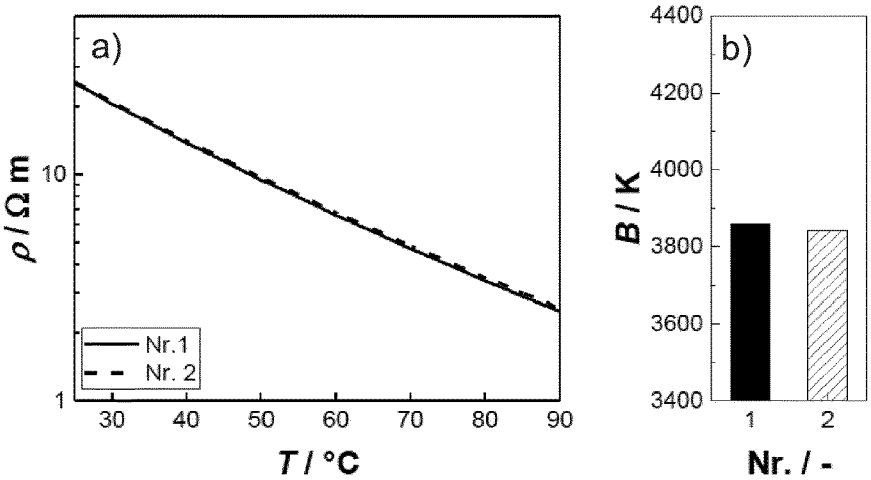

Then, as shown in FIG. 6, the electrode structure 12 is present as burned and an NTCR film (the layer 13 of spinel-based material) having a cubic $NiMn_2O_4$ spinel structure 13 is present. The electrodes 12 shown are so-called interdigital electrodes. They result in a low resistance of the NTCR sensor 17. Depending on the selection of the electrode form, the resistance value can be set in a wide range. A more detailed characterization of the NTCR sensors 17 shown in FIG. 6 is illustrated in FIGS. 7 to 9.

FIG. 7 shows an SEM image of the fractured surface of an NTCR sensor 17 of FIG. 6 that is temperature-treated at 850° C. Following the deposition of NiO and $Mn_2O_3$ compounds, homogenous and scratch-resistant composite layers 10 having thicknesses in the range of approximately 1 to 3 μm thickness could be produced.

The lower half of the SEM image shows the $Al_2O_3$ substrate 2. The spinel-based layer 13, a cubic $NiMn_2O_4$ spinel, is located thereon. It has a good adhesion to the substrate 2, as well as a crack-free and uniform layer morphology. The crack-free and uniform layer morphology is still observed following a 10 minute sintering step carried out at 950° C. The screen-printed and subsequently sintered AgPd interdigital electrodes 12 are located on the spinel-based layer 13. The fractured image in this respect shows the cross-section of a finger of an AgPd interdigital electrode 12.

The layer morphology has however changed from a dense, nanoporous AcD layer as shown in FIG. 5 to a closed pore layer without clearly recognizable pores as shown in FIG. 7. The effect of the pore formation on calcination of the composite layer 10 is presumably due to the reduction in volume as a consequence of the formation of the spinel-structure.

An electrical characterization of the two NTCR sensors 17 that are shown in FIG. 6 is illustrated in FIGS. 8*a* and 8*b*. Both NTCR sensors 17 show the typical behavior of a ceramic thermistor having a B-constant of approximately 3850 K and a specific resistance $\rho_{25}$ at 25° C. of approximately 25 Ωm. FIG. 8*a* in this regard shows the change in specific resistance with respect to temperature in ° C.

Advantageously, both the B-constant (see FIG. 8*b*) and the specific resistance $\rho_{25}$ (see FIG. 8*a*) remain substantially constant at approximately 3850 K and 25 Ωm despite temperature-treating the sensors at different temperatures in the range of 200° C. to 800° C. In order to confirm the stability of the NTCR sensors 17 with respect to resistance and temperature, the two NTCR sensors 17 were each subjected to one-hour lasting temperature treatments at T=200° C., 400° C., 600° C. and 800° C. (see e.g. FIG. 11 in this regard). Between each temperature treatment, the NTCR sensors 17 were allowed to cool down to room temperature at a cooling rate of 10 K/min.

An electrical characterization of each of the two NTCR sensors 17 took place following each temperature treatment step. The results of these measurements are shown in FIGS. 9*a* and 9*b*. Both the B-constant (see FIG. 9*b*) and the specific resistance $\rho_{25}$ (see FIG. 9*a*) substantially maintain their values despite the various temperature treatments.

It should be noted in this connection that on forming the actual NTCR sensors 17, 18, 19 a single heat treatment step of e.g. 850° C. is carried out. This means that one does not have to perform several independent heat treatment steps (as carried out for the stability evaluation) on the manufacture of NTCR sensors 17, 18, 19.

In order to produce the graphs shown in FIG. 9 (NTCR sensor 17) and FIG. 10 (prior art NTCR sensor as explained below), the measurement and temperature cycle depicted in FIG. 11 was used.

The NTC thermistors were measured both once they were deposited as the composite film 10 and subsequently sintered with the electrodes (in case of FIG. 9) or were deposited as spinel-based film 13 on electrode structures (in case of FIG. 10) and after the different heating steps in order to monitor at which temperature the transformation to the layer 13 of spinel-based material took place. The measurements took place in the constant temperature circulator described in the following. For the tempering the heating/cooling rate was 10 K/min and the temperature was maintained for 60 min at each temperature.

Figure 9:
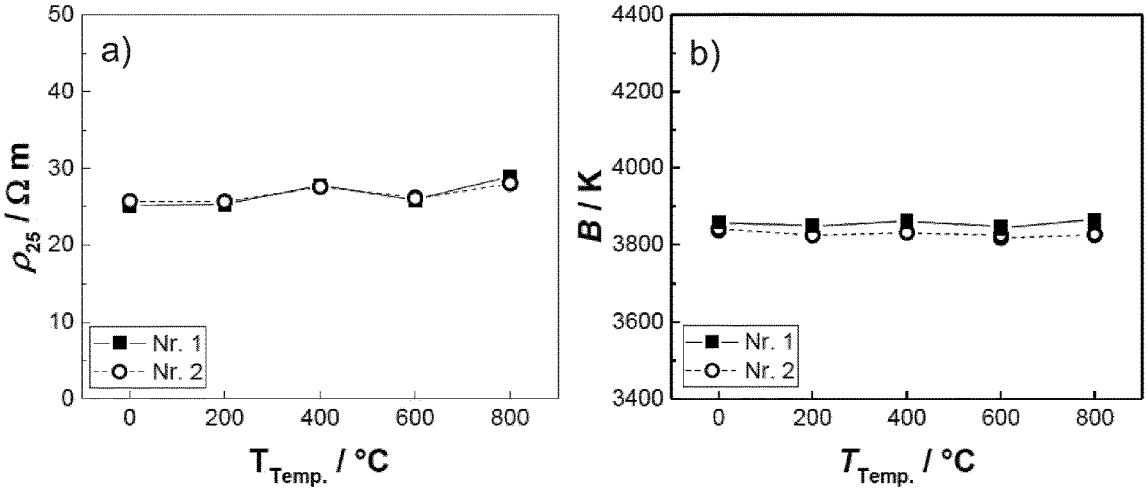

In order to conduct the electric characterization of the NTCR sensors 17 as shown in FIGS. 8 to 10, the measurements were carried out in a constant temperature circulator (Julabo SL-12) at temperatures between 25° C. and 90° C. using a low viscosity silicone oil (DOW CORNING® 200 FLUID, 5 CST) as a measurement liquid. A four-terminal sensing method was used for the investigations using a digital multimeter (Keithley 2700) to measure the electrical resistance in dependence on the temperature. The measurement temperature was detected in the direct vicinity of the NTC thermistor with the aid of a high-precision Pt1OOO resistor. The calculation of the specific resistance $\rho_{25}$ took place across the complete resistor at 25° C. and via the sensing geometry (electrode spacing, electrode width, number of electrode pairs, NTCR layer thickness). The B-constant was determined in accordance with the following relationship via the resistance at 25° C. and 85° C.

$$B = \ln\frac{R_{25}/R_{85}}{\frac{1}{298\text{K}} - \frac{1}{358\text{K}}}$$

Comparative measurements using a different constant temperature circulator showed that the obtained results depicted in FIGS. 8 and 9 could be reproduced.

Figure 12:
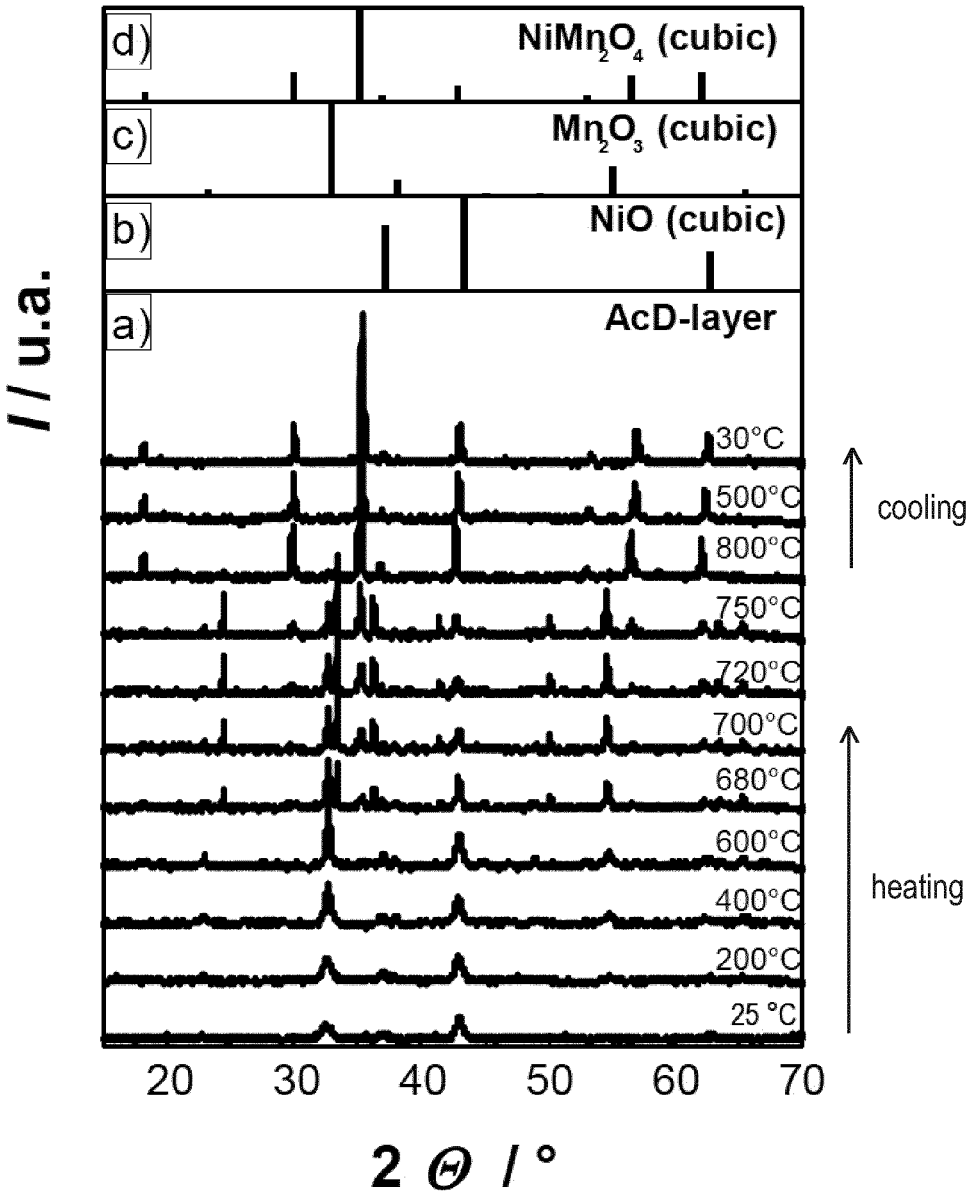

FIG. 12 shows XRD spectra confirming that the film 10 of composite material of NiO—$Mn_2O_3$ is transformed into the layer 13 of spinel-based material having the desired cubic $NiMn_2O_4$-spinel in an air atmosphere on being subjected to a high temperature treatment.

In this regard, FIG. 12*a* shows various XRD spectra of the composite film 10 respectively of the layer 13 of spinel-based material at different temperatures. The lowest spectra of FIG. 12 a shows the XRD spectrum of the composite film 10 prior to any heat treatment, the temperature is subsequently increased for each higher lying XRD spectrum up to a temperature of 800° C. following which the layer 13 of spinel-based material is cooled down again.

The different spectra shown in FIGS. 12*b* to 12*d* relate to reference spectra of respective pure layers. FIG. 12*b* shows the XRD spectrum of a pure NiO layer having a cubic structure. FIG. 12*c* shows the XRD spectrum of a pure $Mn_2O_3$ layer having a cubic structure. FIG. 12*d* shows the XRD spectrum of a pure $NiMn_2O_4$ layer having a cubic structure.

Specifically, following the deposition at 25° C. the composite film 10 has the reflexes of the starting material of NiO and $Mn_2O_3$, i.e. the peaks present in this XRD spectrum correspond to the dominant reflexes found in FIGS. 12*b* and 12*c*. The composite film 10 maintains these reflexes up to a temperature of 400° C. Thus, the deposition of the composite film 10 alone does not bring about a transformation to the layer 13 of spinel-based material. This phase change starts at a heating step in the range of 600° C. to 750° C., where the cubic structure of $NiMn_2O_4$ starts to become apparent, i.e. the dominant peak shown in FIG. 12*d* can first be seen in the XRD spectrum at 600° C. and the amplitude of this peak increases with an increase in temperature. In this intermediate state several Ni—Mn-Oxides are present (cubic $Mn_2O_3$ (Bixbyit), orthothrombic $NiMn_2O_3$ (Ilmenite), tetragonal $Mn_3O_4$ (Hausmannite) and cubic $NiMn_2O_4$ (Spinel)) alongside one another. At a temperature of 800° C., the phase change is completed and only reflexes of the desired cubic $NiMn_2O_4$-Spinel are present. These reflexes, i.e. the cubic $NiMn_2O_4$ structure are/is maintained also after cooling (see FIG. 12*a*) at 500° C. and 30° C.).

In the following, a discussion of the temperature behavior of $NiMn_2O_4$ layers formed using aerosol deposition as discussed e.g. in U.S. Pat. No. 8,183,973 B2 will be presented.

As discussed in the foregoing, in U.S. Pat. No. 8,183,973 B2, a ground powder of completely calcined $NiMn_2O_4$ powder is deposited by means of Aerosol Deposition (AD) using an apparatus such as the one discussed in connection with FIG. 1. The completely calcined $NiMn_2O_4$ powder is deposited onto an $Al_2O_3$ substrate provided with a screen-printed AgPd-electrode structure. Following the generation of the film on the electrode structure, the complete structure is subjected to a heat treatment step. Following the different heat treatment steps carried out at the different temperatures the specific resistance $\rho_{25}$ and the B-constant of the material is measured. The results of these measurements are shown in FIGS. 10*a* and 10*b*. The results shown in FIG. 10 after the 800° C. tempering step ($\rho_{25,\ 800°\ C.}$, $B_{800°\ C.}$) are nearly identical to the measurement results ($\rho_{25,\ 800°\ C.}$, $B_{800°\ C.}$) shown in FIG. 9. However, the tempering behaviour of the sensors shown in FIG. 10 is markedly different to those depicted in FIG. 9. The curves in FIGS. 10*a* and 10*b* show a clear gradient with increasing tempering temperature, while the curves in FIGS. 9*a* and 9*b* are approximately constant. In this way the stability exhibited in the graphs shown in FIGS. 9*a* and 9*b* is not achieved, i.e. with respect to different heat treatments a more instable structure is obtained using the prior art method. Hence, the method described herein leads to the formation of NTCR resistors 17, 18, 19 having at least the same quality as those known from the prior art.

It should be noted that the described heat treatment step used to induce the conversion of the film 10 into the layer 13 of spinel-based material and to induce the sintering of the conductive paste 11 to form the electrode structures 12 is carried out using thermal convection. Other forms of heat treatment step could be employed. In this connection, radiation from a specifically tuned laser or from a microwave source could be used to induce this change in state of the respective layer of structure. It is also conceivable, that if a thermally and electrically conductive layer is provided on the substrate or as a substrate that a sufficiently high current is applied at this layer to induce the desired transformation.

LIST OF REFERENCE NUMERALS

1 apparatus
2 substrate
3 mixture
4 deposition chamber
5 evacuation apparatus
6 aerosol-producing unit
7 nozzle
8 powder mixture having x metal oxide components (x≥2)
9 aerosol
9' carrier gas
9.1 particle of the metal oxide component 1
9.2 particle of the metal oxide component 2
9.3 particle of the metal oxide component 3
**9.*x*** particle of the metal oxide component x
10 composite film (from aerosol-based and vacuum-based cold composite deposition)
1 1 conductive paste
12 electrode/electrode structure
13 spinel-based layer
14 mask
15 filling material particle
16 filling material grain in layer
17 NTCR sensor having interdigital top electrodes
18 NTCR sensor having interdigital bottom electrodes
19 NTCR sensor having sandwich electrodes

The invention claimed is:

1. A method of producing a negative temperature coefficient resistor (NTCR) sensor, the method comprising:

providing a mixture comprising uncalcined powder and providing a carrier gas in an aerosol-producing unit, the uncalcined powder comprising metal oxide components;

forming an aerosol from the mixture and the carrier gas and accelerating the aerosol in a vacuum towards a substrate arranged in a deposition chamber;

forming a film of the uncalcined powder of the mixture on the substrate; and transforming the film into a layer of spinel-based material by applying a heat treatment step.

2. The method in accordance with claim 1, wherein the heat treatment step is applied at a temperature below 1000° C.

3. The method in accordance with claim 2,
wherein the heat treatment step is applied at a temperature in the range of 600° C. to 1000° C.

4. The method in accordance with claim 1, wherein the heat treatment step takes place in an atmosphere, wherein said atmosphere has a controlled partial oxygen pressure.

5. The method in accordance with claim 4,
wherein the heat treatment step is applied at a temperature in the range of 780° C. to 1000° C.

6. The method in accordance with claim 1,
wherein the carrier gas is selected from the group consisting of oxygen, nitrogen, a noble gas, and combinations thereof.

7. The method in accordance with claim 1,
wherein the uncalcined powder comprises particle sizes in the range of 50 nm to 10 μm.

8. The method in accordance with claim 1,
wherein the layer of spinel-based material comprises a spinel composed of two or more cations from the group consisting of Mn, Ni, Co, Cu, Fe, Cr, Al, Mg, Zn, Zr, Ga, Si, Ge and L.

9. The method in accordance with claim 8,
wherein the layer of spinel-based material comprises the chemical formula $M_xMn_{3-x}O_4$, $M_xM'_yMn_{3-x-y}O_4$, and $M_xM'_yM''_zMn_{3-x-y-z}O_4$, wherein M, M' and M'' are selected from the group consisting of Ni, Co, Cu, Fe, Cr, Al, Mg, Zn, Zr, Ga, Si, Ge and Li, and wherein the uncalcined powder comprises compounds of at least one of M, M', or M''.

10. The method in accordance with claim 1,
wherein the uncalcined powder comprises at least two different metal oxide components.

11. The method in accordance with claim 1,
wherein the mixture comprises at least one filling material component.

12. The method in accordance with claim 1,
further comprising forming at least one of a further layer or a structure on at least one of the substrate, the film before applying the heat treatment step, or the layer of spinel-based material.

13. The method in accordance with claim 12,
further comprising the step of sintering the at least one of the further layer or the structure, wherein said heat treatment step is applied as a single heat treatment for transforming the film into the layer of spinel-based material and for sintering the at least one of the further layer or the structure.

14. The method in accordance with claim 12, wherein the at least one of the further layer or the structure is selected from the group consisting of
an electrode, an electrically conducting layer or structure, an electrically insulating layer or structure, a protective film, a thermally conducting layer, and combinations of the foregoing.

15. The method in accordance with claim 12, wherein said at least one of the further layer or the structure is applied using at least one of a thick film technology, a chemical vapor deposition (CVD) process, a physical vapor deposition (PVD) process, a plasma-enhanced chemical vapor deposition (PECVD) process, a sol-gel process, or a galvanization process.

16. The method in accordance with claim 15,
wherein the at least one of the further layer or the structure is structured by at least one of a laser beam, an electron beam, a sand jet, or a photolithographic process.

17. The method in accordance with claim 1,
further comprising introducing at least one mask into the deposition chamber, the at least one mask being arranged between the aerosol-producing unit or the substrate.

18. A method in accordance with claim 1,
further comprising adapting a resistance of the NTCR sensor by changing a size of the film formed on one of the substrate or of the layer of spinel-based material.

19. The method in accordance with claim 18, wherein,
the change in size is effected by a mechanical trimming processes.

20. The method in accordance with claim 1,
wherein the aerosol-producing unit comprises a nozzle via which the aerosol is accelerated towards the substrate,
wherein the forming the film on the substrate comprises moving the substrate and the nozzle relative to one another to define an extent of the film.

* * * * *